US010799932B2

(12) United States Patent
Kim

(10) Patent No.: US 10,799,932 B2
(45) Date of Patent: Oct. 13, 2020

(54) ROLLER HEMMING APPARATUS

(71) Applicants: HYUNDAI MOTOR COMPANY, Seoul (KR); KIA MOTORS CORPORATION, Seoul (KR)

(72) Inventor: Ock Do Kim, Ulsan (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 341 days.

(21) Appl. No.: 15/830,663

(22) Filed: Dec. 4, 2017

(65) Prior Publication Data

US 2019/0070655 A1 Mar. 7, 2019

(30) Foreign Application Priority Data

Sep. 7, 2017 (KR) ..... 10-2017-0114485

(51) Int. Cl.
*B21D 39/02* (2006.01)

(52) U.S. Cl.
CPC ..... *B21D 39/023* (2013.01); *B21D 39/02* (2013.01); *Y10T 29/53791* (2015.01)

(58) Field of Classification Search
CPC ... B21D 5/06; B21D 5/08; B21D 5/10; B21D 5/12; B21D 7/08; B21D 7/085; B21D 39/02; B21D 39/023; B21D 51/32; B21D 53/88; B21D 22/14–16; B21D 1/02; B21D 1/06; B21D 1/12; B21D 1/14; B21D 3/02–08; B21D 19/04; B21D 19/043; Y10T 29/53787; Y10T 29/53791
See application file for complete search history.

(56) References Cited

U.S. PATENT DOCUMENTS 3,868,839 A * 3/1975 Sentourens ..... B21D 1/06 72/14.4
4,976,126 A * 12/1990 Yamamoto ..... B21D 22/16 72/81
5,228,190 A * 7/1993 Sawa ..... B21D 39/021 29/243.57
7,500,373 B2 * 3/2009 Quell ..... B21D 39/021 29/243.58
7,855,350 B2 * 12/2010 Schurmann ..... B23K 26/03 219/121.63
7,870,774 B2 1/2011 Hasegawa et al.
7,987,689 B2 * 8/2011 Toeniskoetter ..... B21D 19/043 72/214
2005/0229666 A1 * 10/2005 Toeniskoetter ..... B21D 39/021 72/220
2008/0184544 A1 8/2008 Hasegawa et al.
(Continued)

FOREIGN PATENT DOCUMENTS

KR 10-0966476 B1 6/2010

*Primary Examiner* — Edward T Tolan
(74) *Attorney, Agent, or Firm* — Brinks Gilson & Lione

(57) ABSTRACT

The present disclosure provides a roller hemming apparatus including a hemming bed including a frame and a die, wherein the hemming bed is detachably coupled to a workpiece, and a roller head including a plurality of hemming rollers that is configured to hem an edge of the workpiece by stages. A press force that presses the edge of the workpiece is adjusted by moving the plurality of the hemming rollers along a first direction with a first cylinder when each hemming roller of the plurality of hemming rollers hems the edge of the workpiece.

16 Claims, 13 Drawing Sheets

(56) References Cited

U.S. PATENT DOCUMENTS

| | | | | |
|---|---|---|---|---|
| 2008/0236236 | A1* | 10/2008 | Toeniskoetter | B21D 39/021 72/220 |
| 2008/0245124 | A1* | 10/2008 | Chaker | B21D 39/021 72/214 |
| 2008/0250835 | A1* | 10/2008 | Hasegawa | B21D 39/021 72/220 |
| 2009/0235713 | A1* | 9/2009 | Toeniskoetter | B21D 39/021 72/220 |
| 2010/0313621 | A1* | 12/2010 | Kumagai | B21D 39/021 72/220 |
| 2014/0196516 | A1* | 7/2014 | Shaw | B21D 39/023 72/214 |
| 2016/0136709 | A1* | 5/2016 | Naderer | B21D 39/023 72/214 |

* cited by examiner

ROLLER HEMMING APPARATUS

CROSS-REFERENCE TO RELATED APPLICATION

The present application claims priority to and the benefit of Korean Patent Application No. 10-2017-0114485, filed on Sep. 7, 2017, which is incorporated herein by reference in its entirety.

FIELD

The present disclosure relates to a roller hemming apparatus having a plurality of hemming rollers, and more particularly, to a roller hemming apparatus that may improve maintainability through a simple and robust structure and may stably secure hemming quality by adjusting pressing forces of hemming rollers through feedback control when an edge of a workpiece is hemmed.

BACKGROUND

The statements in this section merely provide background information related to the present disclosure and may not constitute prior art.

In general, vehicles are manufactured through several processes of assembly involving tens of hundreds of parts in all assembly processes.

For example, a vehicle body assembly process is a first stage of a vehicle manufacturing process, and a vehicle body (a body in white) is manufactured via a process of assembling a product panel in a vehicle body factory after the product panel is produced through various types of press equipment.

In this way, in order to form a panel of a vehicle body, a steel plate is pressed into a specific form through various types of press equipment, and undergoes machining operations, such as cutting, hole machining, bending, and curving, in processes such as trimming, piercing, flanging, and hemming.

Meanwhile, edges of a wheel arch, a fender, and the like of the vehicle body is machined through a hemming process. In general, the vehicle body includes an inner panel and an outer panel, and the inner panel and the outer panel are coupled to each other at an edge of the vehicle body through a hemming operation.

In most current hemming methods, a mold of a panel is mounted to a dedicated press type machine, an outer panel and an inner panel are introduced into the interior of the mold, and ends of the panels are bent to be coupled to each other by lowering a press mold.

However, in the press hemming, because a high-priced mold has to be manufactured in a similar way in which the panel is formed, equipment investment costs may increase, and because the size of the press body is considerably large, the press hemming may be undesirable in configuration of a layout in a factory.

In order to deal with the above-mentioned issues, roller hemming that uses a robot has mainly applied. In the roller hemming using a robot, a roller hemming apparatus, to which a multi-joint arm of a robot is mounted, is used. For example, the roller hemming apparatus includes a roller head fixed to the multi-joint arm of the robot, and the roller head has a preliminary hemming roller and a main hemming roller.

In the roller hemming process using a roller hemming apparatus, the inner panel and the outer panel of the workpiece are coupled to each other at an edge of a workpiece by preliminarily hemming a flange part of the outer panel through a preliminary hemming roller while moving a robot along a style line of a jig in a state in which the inner panel and the outer panel are clamped. Lastly, the flange part of the outer panel is hemmed through a main hemming roller after applying a sealant to an inner part of a flange.

However, in the roller hemming process, lack of bending degree or turn-down may be caused as examples of defects of the hemming in spite that the roller hemming is very important as it influences gaps, steps, and quality of an external appearance of the parts.

Further, because the hemming head may be damaged due to the repulsive forces generated between the hemming rollers and an edge of the workpiece when the edge of the workpiece is hemmed by the hemming rollers, the maintainability of the roller hemming apparatus may be difficult, and hemming quality cannot be sufficiently secured and a plurality of hemming defects may occur.

Further, robot teaching has to be individually corrected when the hemming quality problem occurs, and accordingly, it may be difficult to improve hemming quality due to the roller hemming apparatus.

The items described in this section are written to enhance understanding of the background of the present disclosure, and may include items that have not been known to an ordinary person skilled in the art to which the present disclosure pertains.

SUMMARY

The present disclosure provides a roller hemming apparatus having a plurality of hemming roller, and more particularly, to a roller hemming apparatus that may improve maintainability through a simple and robust structure and may stably secure hemming quality by adjusting pressing forces of hemming rollers through feedback control when an edge of a workpiece is hemmed.

The technical aspects of the present disclosure are not limited to the above-mentioned one, and the other unmentioned technical aspects will become apparent to those skilled in the art from the following description.

In one aspect of the present disclosure, a roller hemming apparatus may include: a hemming bed including a frame and a die, wherein the hemming bed is detachably coupled to a workpiece, and a roller head including a plurality of hemming rollers configured to hem an edge of the workpiece by stages, wherein a press force that presses the edge of the workpiece is adjusted by moving the plurality of hemming rollers along a first direction with a first cylinder when each hemming roller of the plurality of hemming rollers hem the edge of the workpiece.

A first adjusting valve configured to adjust a flow rate of fluid supplied to the first cylinder may be connected to the first cylinder, and the first adjusting valve may have a first solenoid configured to adjust a degree of valve opening.

A first controller having a pair of sensors that are configured to detect a feedback signal of the first solenoid, wherein the first controller is configured to connect to the first solenoid, compare the feedback signal with a first setting level and adjust a voltage or a current supplied to the first solenoid.

The first setting level may be set to the voltage or the current that is supplied to the first solenoid such that the edge of the workpiece is smoothly bent.

The first adjusting valve may be an electro-pneumatic proportional valve.

The roller head may further include one or more guide rollers, and the guide roller may be disposed on a side that faces at least one hemming roller of the plurality of hemming rollers and the guide roller is configured to apply an opposing force that is applied against a press force on an opposite side of the at least one hemming roller of the plurality of hemming roller when the at least one hemming roller of the plurality of hemming roller presses the edge of the workpiece with the press force.

The guide roller may be configured to move along the first direction by a second cylinder such that the opposing force is adjusted.

A second adjusting valve having a second solenoid that is configured to adjust a degree of valve opening, wherein the second adjusting valve is configured to adjust a flow rate of fluid supplied to the second cylinder, and connect to the second cylinder.

A second controller having a pair of sensors may be connected to the second solenoid, and the second controller may compare a feedback signal of the second solenoid with a second setting level, wherein the pair of sensors are configured to detect the feedback signal of the second solenoid, and adjust a voltage or a current supplied to the second solenoid.

The second setting level may be set to the voltage or the current that is supplied to the second solenoid such that the edge of the workpiece is smoothly bent.

The second adjusting valve may be an electro-pneumatic proportional valve.

The roller head may further include a carrier, to which a wrist assembly of a robot arm is detachably coupled, and the plurality of hemming rollers may be connected to the carrier through the first cylinder.

A floating unit may be connected to the carrier and the floating unit moves the plurality of hemming rollers in three axis direction, wherein each axis of three axes is perpendicular to one another.

The hemming bed may include the frame, the die connected to the frame, and a guide member detachably coupled to the die, and the die may contact the workpiece and the guide member may have a guide groove that is configured to guide the guide roller.

The die may include a first surface contacting an outer surface of the workpiece, and a second surface formed on an opposite side of the first surface, and the guide member may be detachably mounted on the second surface through a coupling device.

A location of the guide member may be adjustable on the second surface of the die.

The die may have a pair of adjusting ribs formed on both ends of the die, the guide member may have a pair of supporting member corresponding to the pair of adjusting ribs, and adjusting members may be interposed between the support members and the adjusting ribs.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various foams thereof, given by way of example, reference being made to the accompanying drawings, in which.

Figure 1:
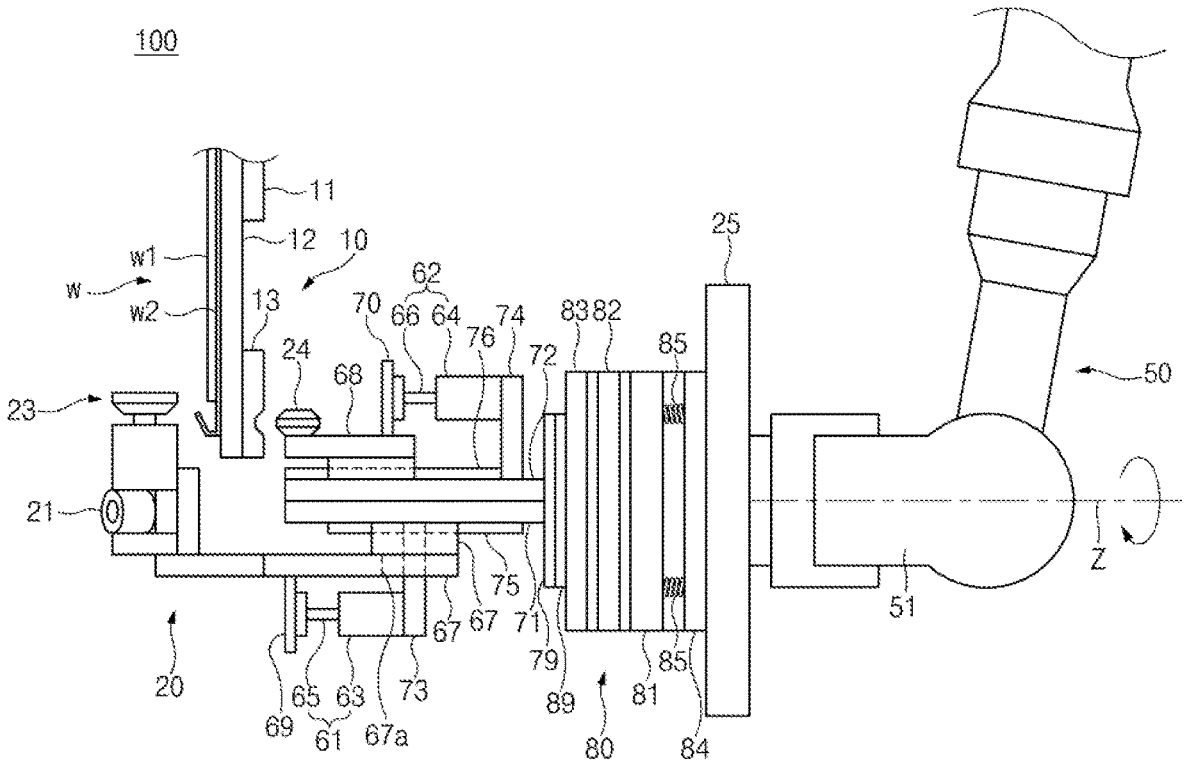
FIG. 1 is a side view illustrating a roller hemming apparatus.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of the present disclosure will be described in detail with reference to the accompanying drawings. Further, in the following description of the present disclosure, a detailed description of known functions and configurations incorporated herein will be omitted when it may make the subject matter of the present disclosure rather unclear.

In addition, terms, such as first, second, A, B, (a), (b) or the like may be used herein when describing components of the present disclosure. The terms are provided only to distinguish the elements from other elements, and the essences, sequences, orders, and numbers of the elements are not limited by the terms. In addition, unless defined otherwise, all terms used herein, including technical or scientific terms, have the same meanings as those generally understood by those skilled in the art to which the present disclosure pertains. The terms defined in the generally used dictionaries should be construed as having the meanings that coincide with the meanings of the contexts of the related technologies, and should not be construed as ideal or excessively formal meanings unless clearly defined in the specification of the present disclosure.

Referring to FIG. 1, a roller hemming apparatus 100 in some foams of the present disclosure may include a hemming bed 10 coupled to a workpiece W to be separable, and a roller head 20 configured to hem an edge of the workpiece W by stages.

Figure 2:
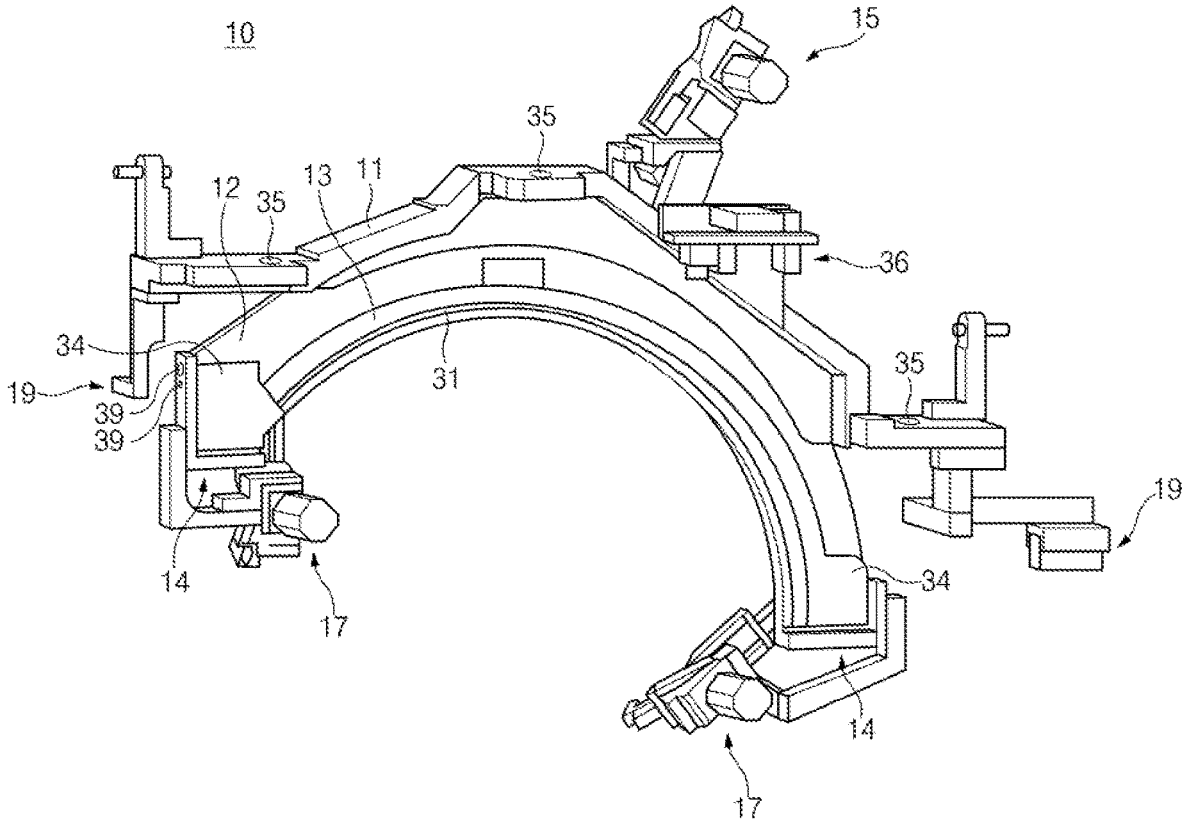
FIG. 2 is a perspective view illustrating a hemming bed of a roller hemming apparatus.
Figure 3:
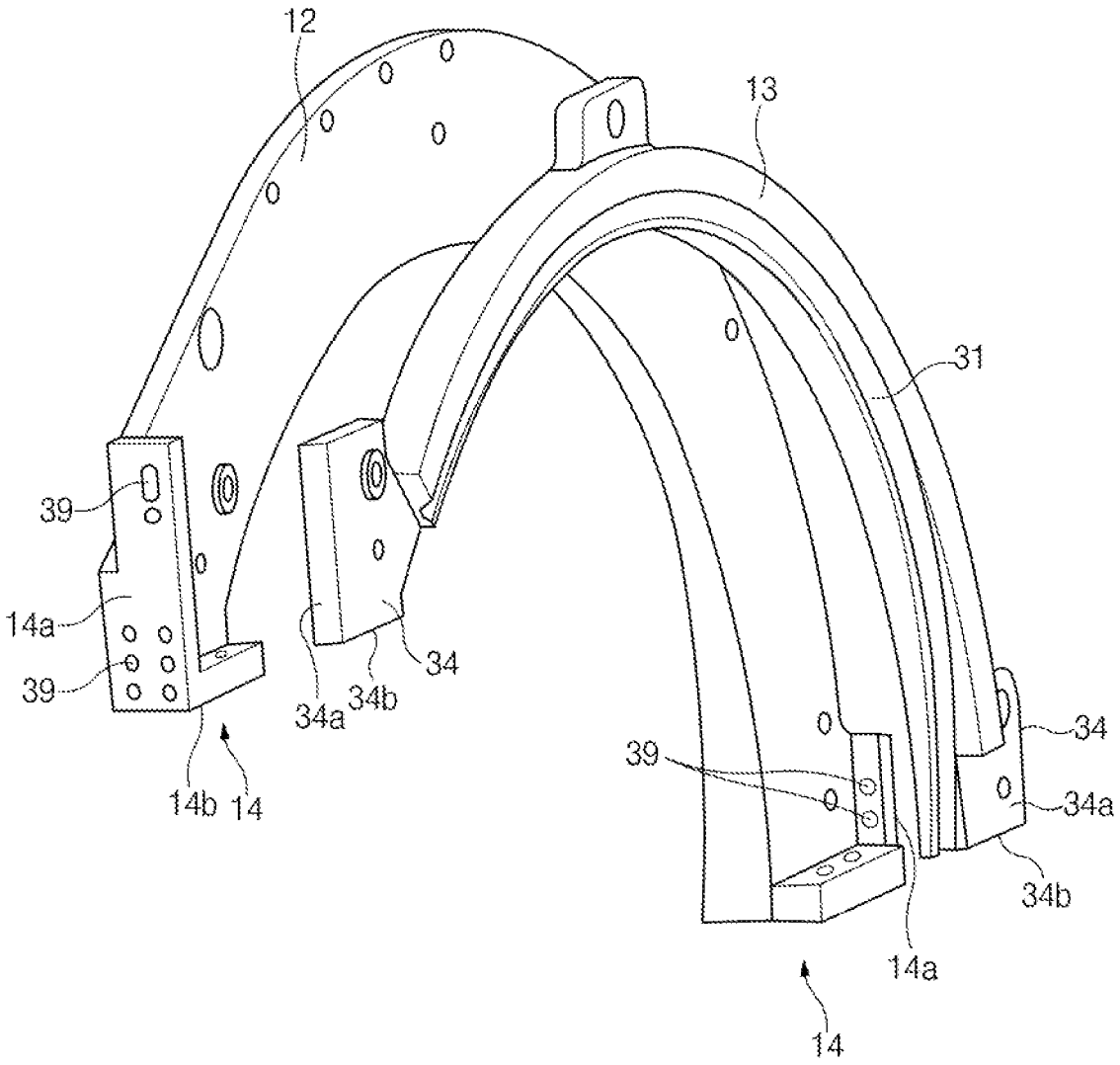
FIG. 3 is an exploded perspective view illustrating a die and a guide member of a roller hemming apparatus.
Figure 4:
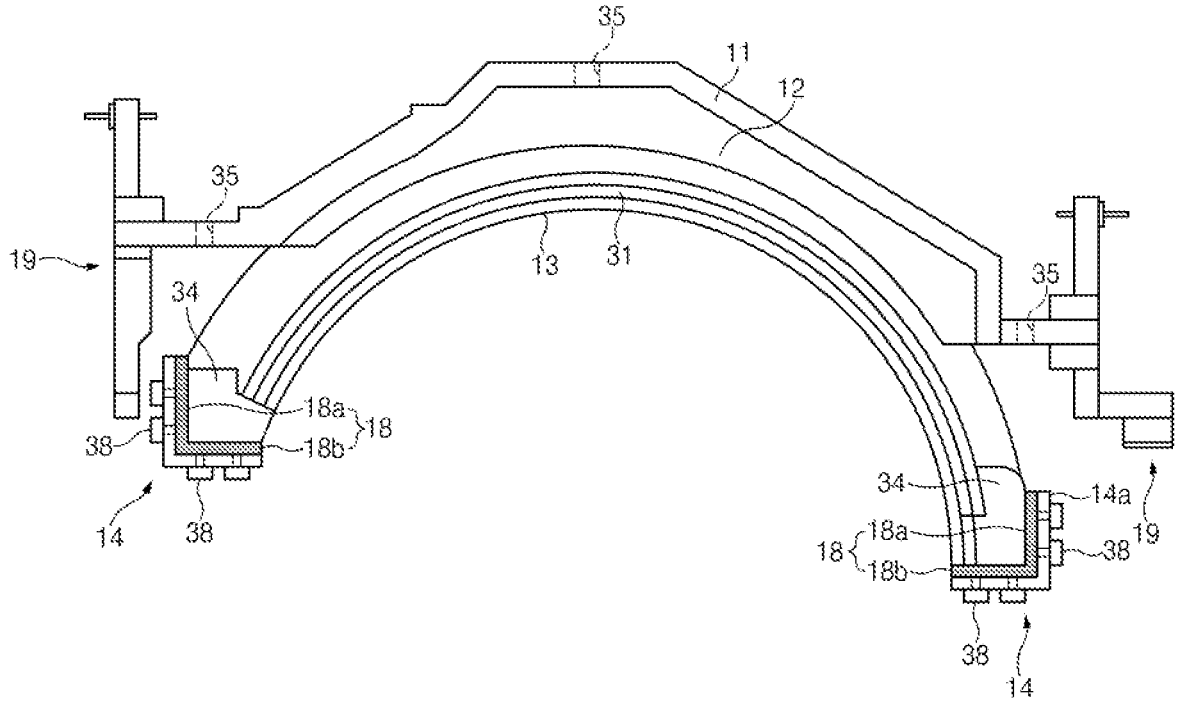
FIG. 4 is a front view illustrating a hemming bed of a roller hemming apparatus.
Figure 5:
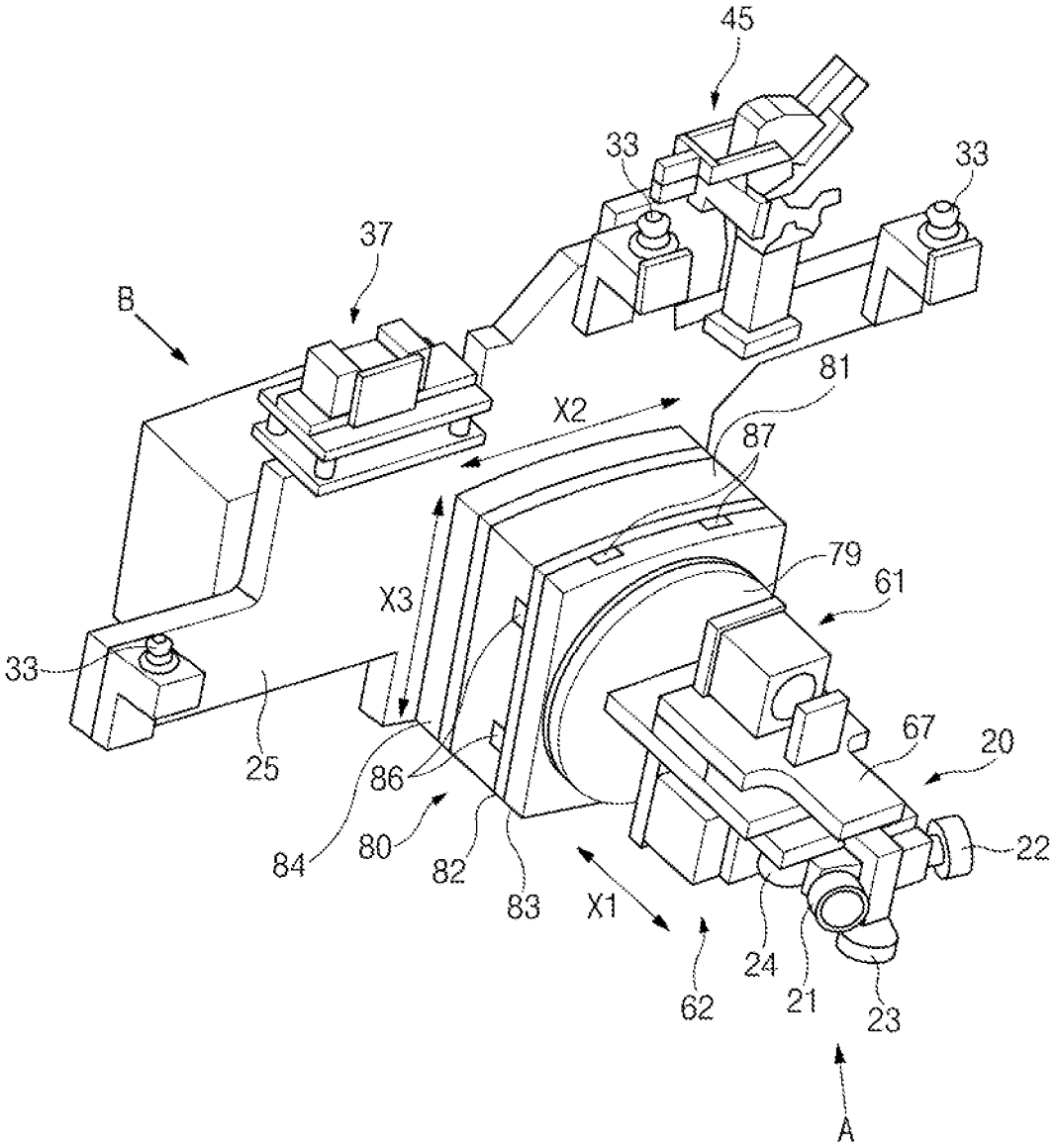
FIG. 5 is a perspective view illustrating a roller head of a roller hemming apparatus.
Figure 6:
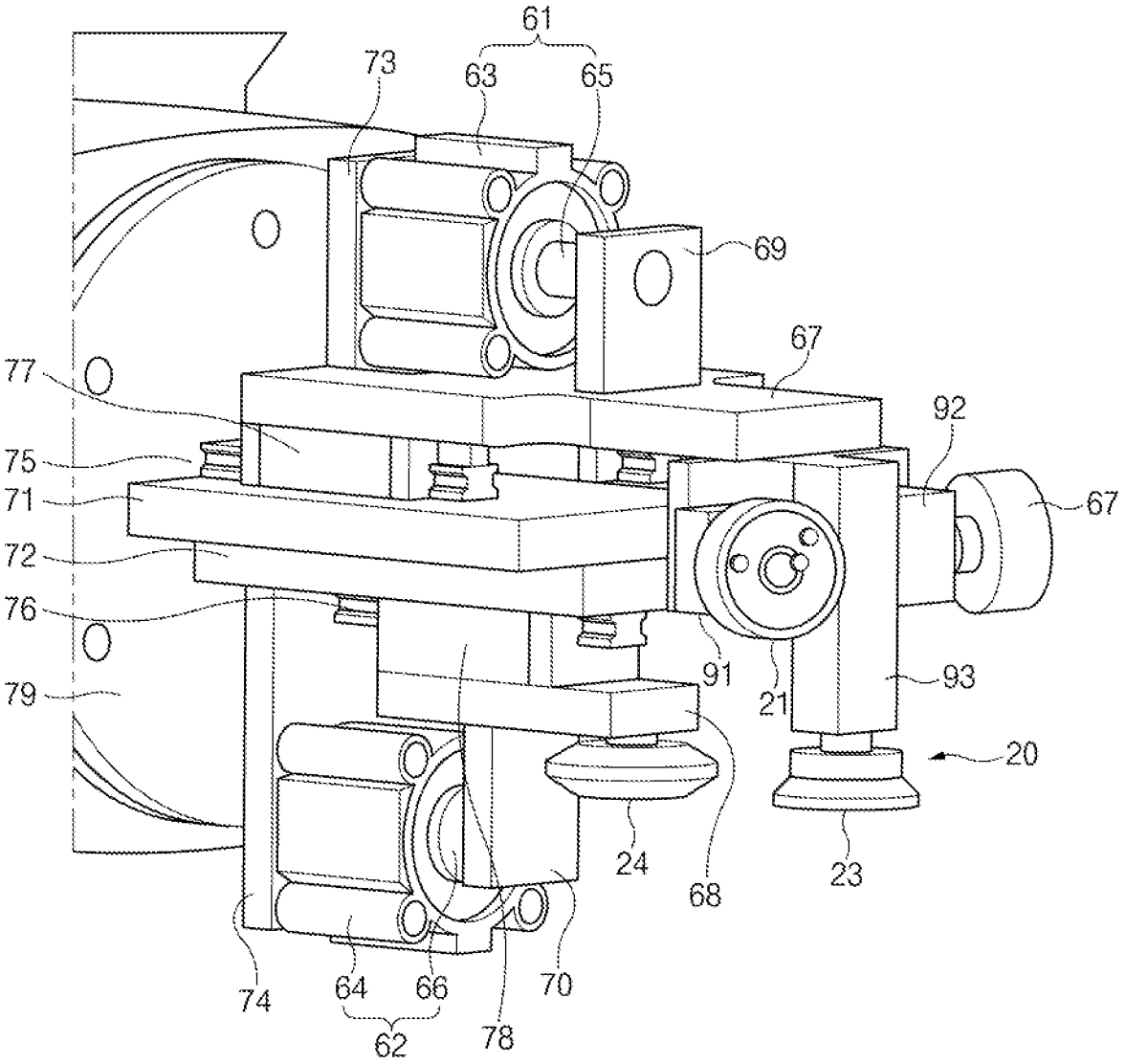
FIG. 6 is a perspective view viewed from a direction of arrow A of FIG. 5.
Figure 7:
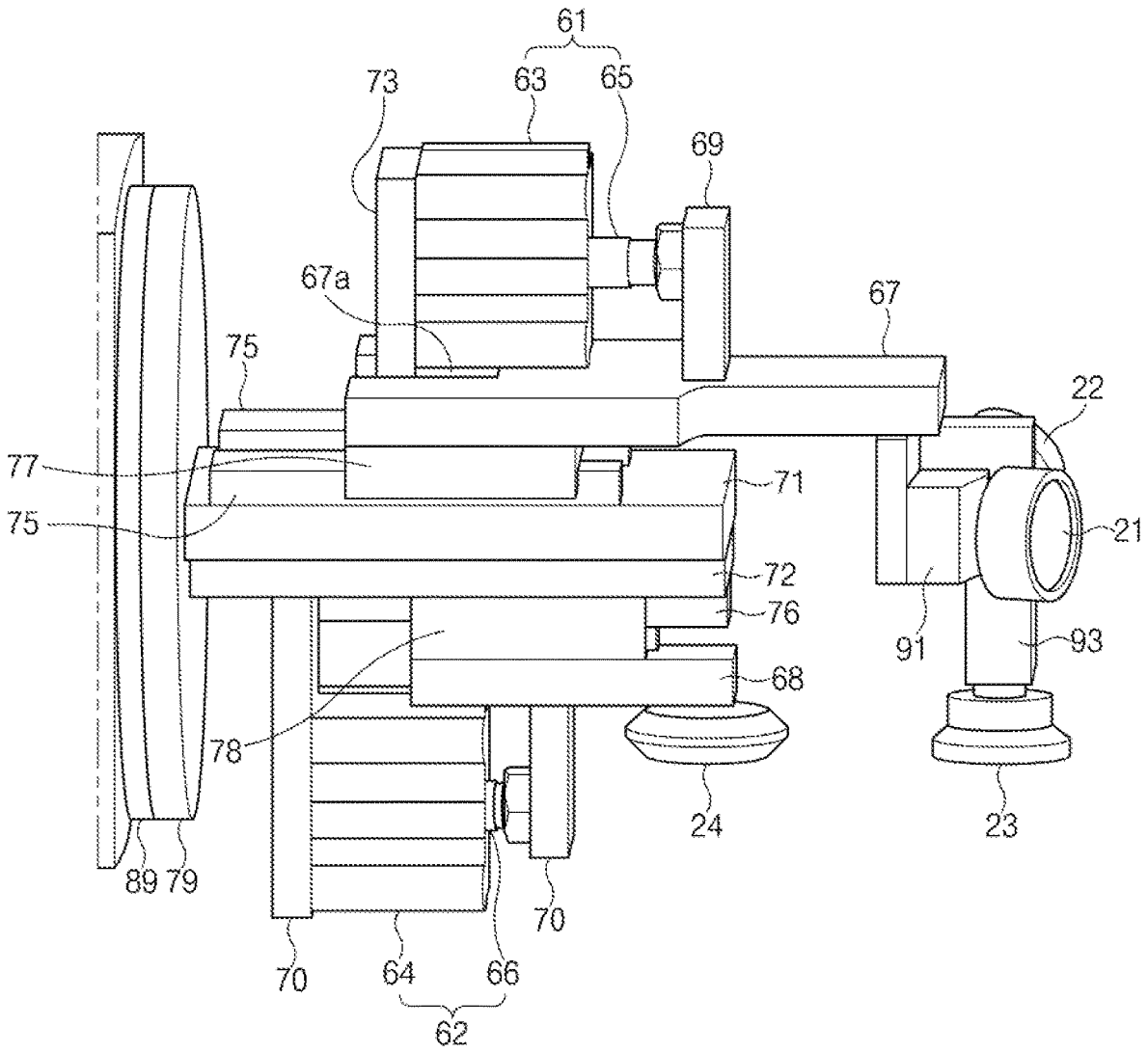
FIG. 7 is a side view illustrating a roller head of a roller hemming apparatus.
Figure 8:
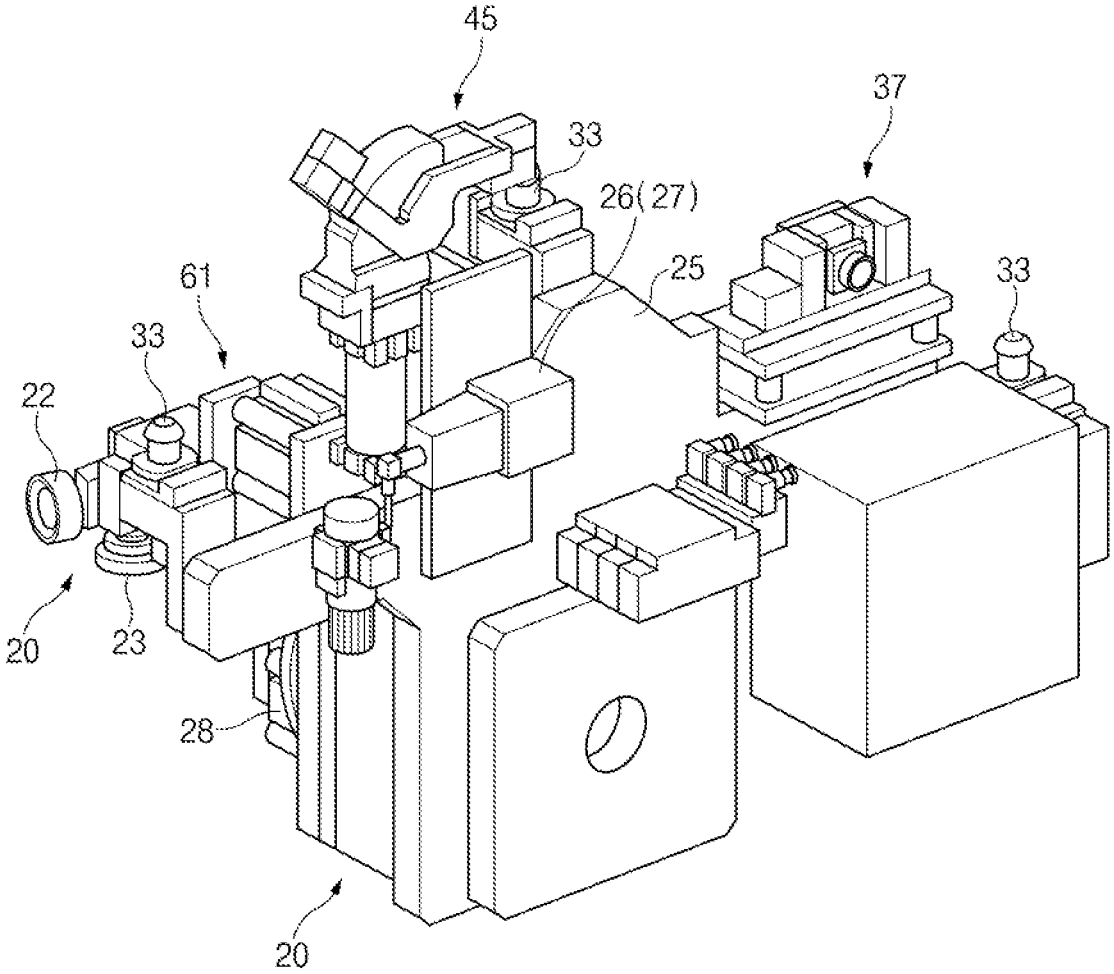
FIG. 8 is a perspective view viewed from a direction of arrow B of FIG. 5.

Referring to FIGS. 2 to 4, the hemming bed 10 may include a frame 11 and a die 12 connected to the frame 11.

The frame 11 may have one or more clamps 15. The frame 11 may be coupled to the workpiece W, such as a vehicle body, by the one or more clamps 15.

A pair of support members 19 may be provided at opposite ends of the frame 11 and may be attached to the workpiece W or contact the workpiece W, and accordingly, the frame 11 may be prevented from being inclined to a left or right direction by supporting the pair of support members 19 on the workpiece W when the frame 11 is clamped to the workpiece W by the clamps 15 so that the frame 11 may be supported in a horizontal direction in a balanced way.

The die 12 may have a shape corresponding to the edge of the workpiece W. In some forms of the present disclosure, as illustrated in FIGS. 2 to 4, the workpiece W may be a wheel arch of the vehicle body, and accordingly, the die 12 may have an arc shape in correspondence to the wheel arch of the vehicle body.

The die 12 may have one or more clamps 16 and 17, and accordingly, the die 12 may be coupled to the workpiece W by the one or more clamps 16 and 17 to be separable.

Figure 9:
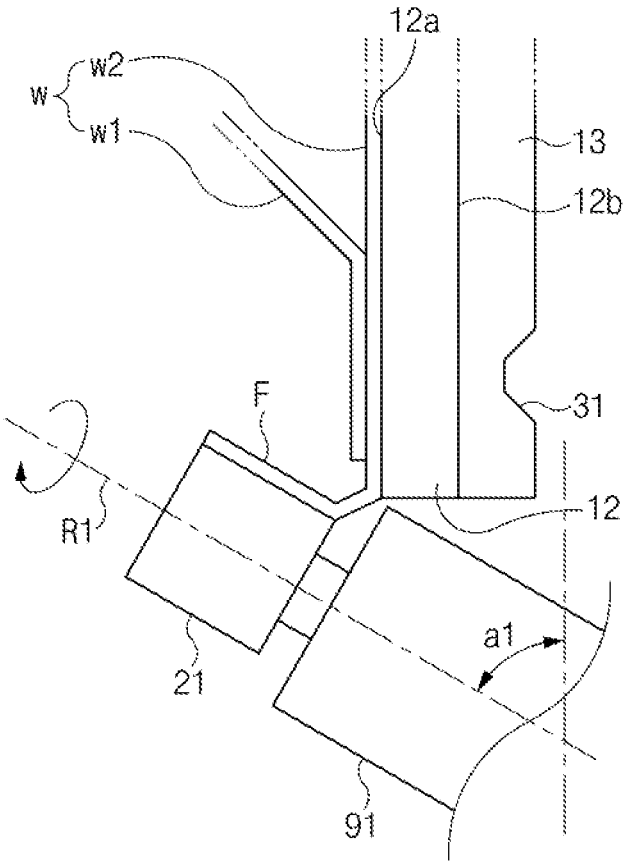
FIG. 9 is a view illustrating a primary preliminary hemming process of a roller hemming apparatus.
Figure 10:
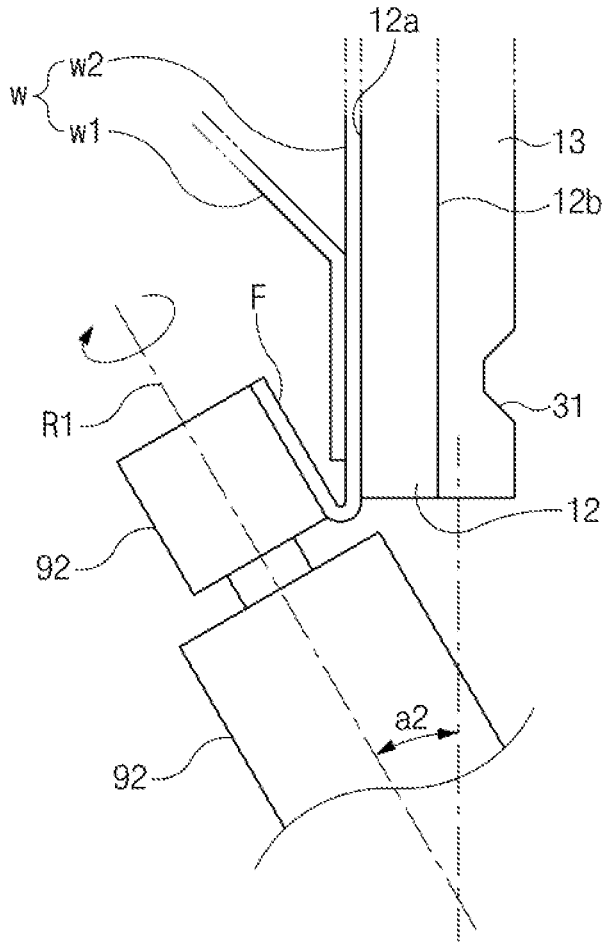
FIG. 10 is a view illustrating a secondary preliminary hemming process of a roller hemming apparatus.
Figure 11:
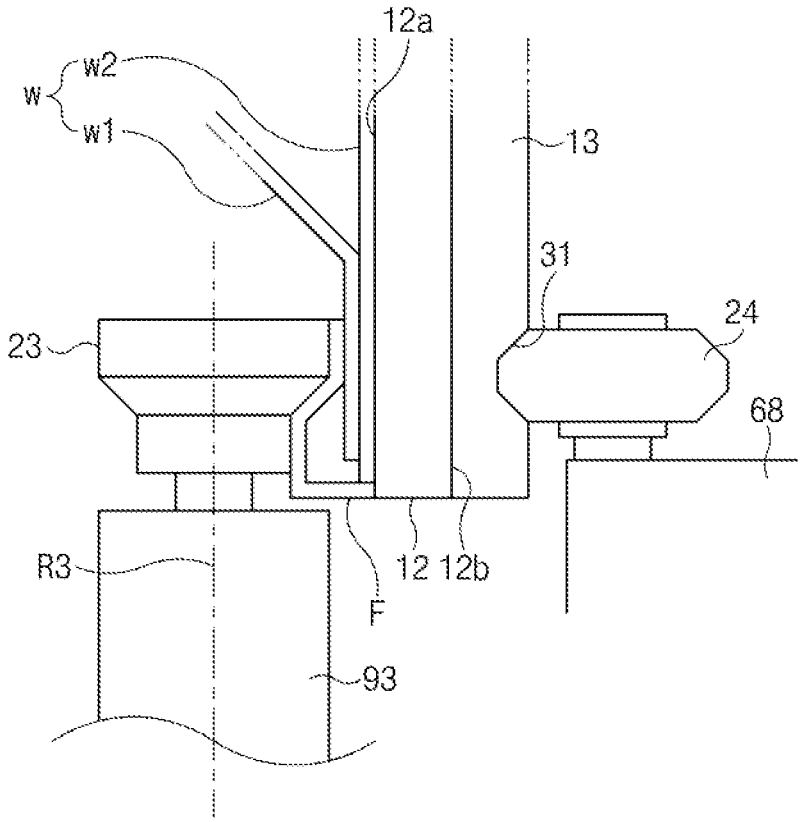
FIG. 11 is a view illustrating a main hemming process of a roller hemming apparatus.

As illustrated in FIGS. 9 to 11, the die 12 may have a first surface 12*a* contacting an outer surface of the workpiece W, and a second surface 12*b* formed on an opposite side of the first surface 12*a*.

The guide member 13 may be mounted on the second surface 12*b*, through a fastener such as a bolt, to be separable, and the guide member 13 may have a shape corresponding to the edge of the workpiece W.

In some forms of the present disclosure, as illustrated in FIGS. 2 to 4, the work piece W may be a wheel arch of the vehicle body, and accordingly, the guide member 13 may have an arc shape in correspondence to the wheel arch of the vehicle body.

The guide member 13 may have a guide groove 31, and the guide groove 31 may extend along a lengthwise direction of the guide member 13. A guide roller 24, which will be described below, may be guided by the guide groove 31 of the guide member 13.

A pair of adjusting ribs 14 may be formed at both ends of the die 12, and each of the adjusting ribs 14 may have a plurality of bolt holes 39. A plurality of adjusting bolts 38 may be individually screw-coupled to the plurality of bolt holes 39.

Each of the adjusting ribs 14 may have a vertical wall 14*a* extending vertically and a horizontal wall 14*b* extending horizontally.

A pair of supporting members 34 may be formed at opposite ends of the guide member 13, and each of the supporting members 34 may have a vertical surface 34*a* extending vertically and a horizontal wall 34*b* extending horizontally. The vertical surfaces 34*a* of the supporting members 34 and the vertical walls 14*a* of the adjusting ribs 14 may face each other, and the horizontal surface 34*b* of the supporting member 34 and the horizontal walls 14*b* of the adjusting ribs 14 may face each other.

Adjusting members 18 may be between the supporting member 34 of the guide member 13 and the adjusting ribs 14. Each of the adjusting members 18 may have a vertical part 18*a* extending vertically and a horizontal part 18*b* extending horizontally.

The vertical parts 18*a* may be interposed between the vertical surfaces 34*a* of the supporting member 34 and the vertical walls 14*a* of the adjusting ribs 14, and the horizontal parts 18*b* may be interposed between the horizontal surface 34*b* of the supporting member 34 and the horizontal walls 14*b* of the adjusting ribs 14.

A plurality of vertical parts 18*a* and a plurality of horizontal parts 18*b* having different thicknesses may be provided in the adjusting members 18, and a location of the guide member 13 may be adjusted along a vertical direction and a horizontal direction by selectively interposing any one of the plurality of adjusting members 18 between the support 34 and the adjusting rib 14. For example, after the location of the guide member 13 is adjusted, the adjusted location of the guide member 13 may be fixed by screw-coupling the plurality of adjusting bolts 38 to the plurality of coupling holes 39. A movement locus of the guide roller 24, which will be described below, may be mechanically corrected through adjustment of the location of the guide member 13.

The roller head 20 may include a carrier 25, to which a wrist assembly 51 of a robot arm 50 is coupled to be separable, and a plurality of hemming rollers 21, 22, and 23 connected to the carrier 25.

The wrist assembly 51 of the robot arm 50 may be coupled to a back surface of the carrier 25, and the wrist assembly 51 of the robot arm 50 may be rotated around a rotational axis Z. The carrier 25 may be rotated around the rotational axis Z of the wrist assembly 51 through rotation of the wrist assembly 51.

The plurality of hemming rollers 21, 22, and 23 may be disposed on a front surface of the carrier 25, and the plurality of hemming rollers 21, 22, and 23 may be mounted to be moved along a first direction X1 by a first cylinder 61. A press force for pressing the edge of the workpiece W may be adjusted by moving the hemming rollers 21, 22, and 23 along the first direction X1 by the first cylinder 61 when the edge of the work piece W is hemmed by the hemming rollers 21, 22, and 23.

Figure 12:
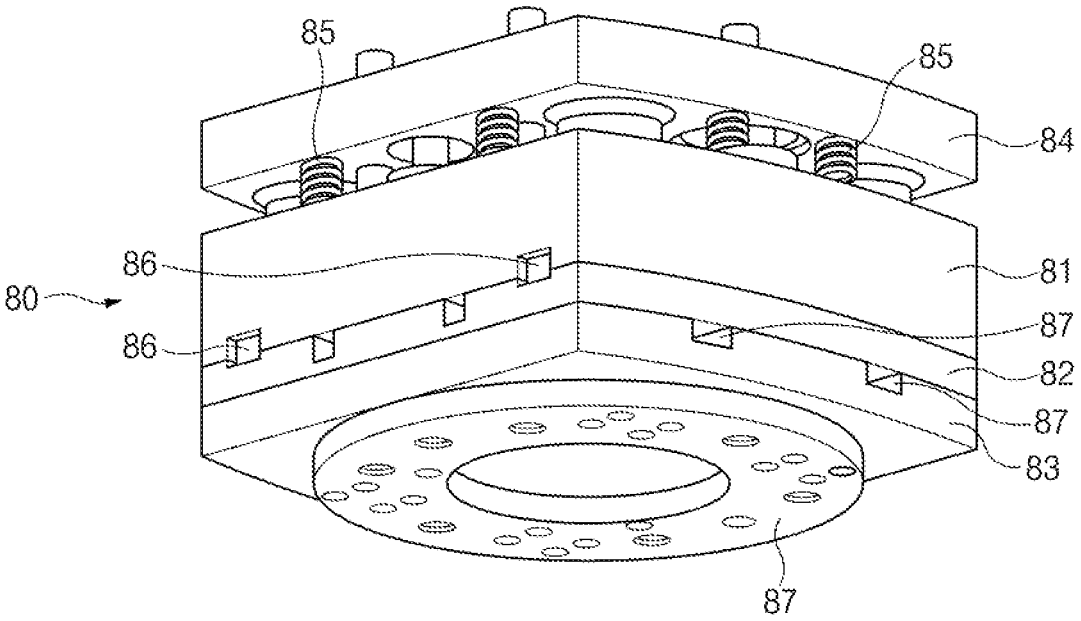
FIG. 12 is a perspective view illustrating a floating unit of a roller hemming apparatus.
Figure 13:
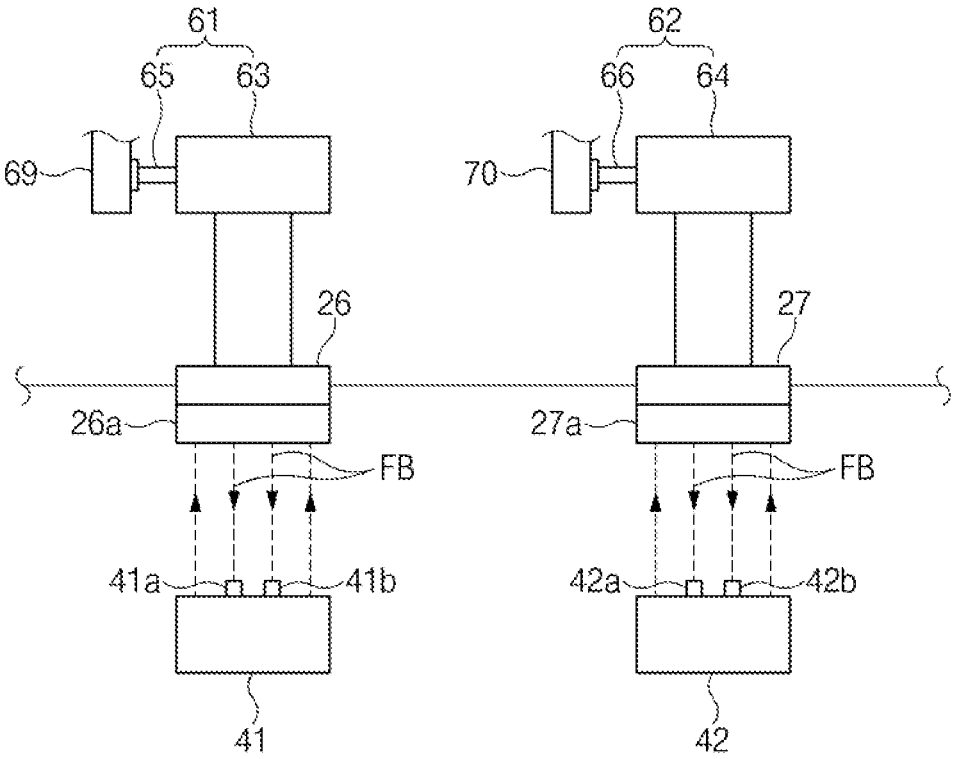
FIG. 13 is a view illustrating a feedback control system connected to first and second cylinders of a roller hemming apparatus.

As illustrated in FIG. 12, the first cylinder 61 may be a pneumatic or hydraulic cylinder that is operated as a fluid, such as air or oil, is supplied. A first adjusting valve 26 may be connected to the first cylinder 61, and the first adjusting valve 26 may be configured to adjust the flow rate of the fluid supplied to the first cylinder 61. The first adjusting valve 26 may have a first solenoid 26*a* that adjusts a degree of valve opening. As the degree of valve opening of the first adjusting valve 26 is adjusted by the first solenoid 26*a*, the flow rate of the fluid supplied to the first cylinder 61 may be adjusted. For example, the first adjusting valve 26 may be an electro-pneumatic proportional valve.

A first controller 41 may be connected to the first solenoid 26*a* of the first adjusting valve 26, and the first controller 41 may have a pair of sensors 41*a* and 41*b* that detects a feedback signal FB, such as a voltage or a current of the first solenoid 26*a*. The first controller 41 may compare the feedback signal FB detected by the pair of sensors 41*a* and 41*b* with a first setting level to adjust a voltage or a current supplied to the first solenoid 26*a*. The flow rate of the fluid supplied to the first cylinder 61 may be adjusted by adjusting the degree of valve opening of the first adjusting valve 26 as the voltage or current supplied to the first solenoid 26*a* is adjusted, and accordingly, the press force with which the edge of the workpiece W is pressed by the hemming rollers 21, 22, and 23 may be adjusted. Here, the first setting level may be set to the voltage or current supplied to the first solenoid 26*a* when the edge of the work piece W is smoothly bent.

In this way, because the press forces of the hemming rollers 21, 22, and 23 may be adjusted by the first cylinder 61, the first adjusting valve 26, the first controller 41, and the like according to the type and the structure of the workpiece W band sections of the edge, the hemming quality of the workpiece W may be remarkably improved. For example, the press forces of the hemming rollers 21, 22, and 23 may decrease to a minimum value because the curving of the short part of the flange F needs to be minimized when the workpiece W is a wheel arch of the vehicle, and the press forces of the hemming rollers 24 may increase to a maximum value because the bending of the long part of the flange F needs to be maximized.

The first cylinder 61 may have a first cylinder housing 63 and a cylinder rod 65. The first cylinder rod 65 may be mounted on the first cylinder housing 63 to be movable along a first direction X1. A first movable member 67 is fixed to an end of the first cylinder rod 65, and accordingly, the first movable member 67 may be moved along the first direction X1 as the first cylinder rod 65 moves.

The first cylinder housing 63 of the first cylinder 61 may be fixedly connected to a first plate 71 by a first bracket 73, and the first plate 71 may extend along the first direction X1.

A first guide rail 75 may be mounted on the first plate 71, and the first guide rail 75 may extend along the first direction X1. A first slider 77 may be installed in the first guide rail 75 to be slid, and the first movable member 67 may be fixed to the first slider 77.

A connection piece 69 protrudes from one side of the first movable member 67. The first cylinder rod 65 of the first cylinder 61 may be fixed to the connection piece 69 of the first movable member 67. Accordingly, as the first cylinder rod 65 moves forwards or rearwards, the first movable member 67 and the first slider 77 may be moved along the first direction X1 and the movement of the first movable member 67 may be precisely guided by the first slider 77 and the first guide rail 75.

The first movable member 67 may have a groove 67*a*, and the groove 67*a* may extend along the first direction X by a specific length. The first bracket 73 may pass through the groove 67*a* of the first movable member 67, one end of the first bracket 73 may be fixed to the first plate 71, and the first cylinder housing 63 may be fixed to an opposite end of the first bracket 73. In this way, because the first bracket 73 is fixed to the first plate 71 after passing through the groove 67*a* of the first movable member 67, the first cylinder housing 63 may be fixedly connected to the first plate 71 through the first bracket 73.

Accordingly, because the groove 67*a* of the first movable member 67 and the first bracket 73 may be prevented from interfering with each other because the first bracket 73*a* is located in the groove 67*a* when the first movable member 67 is moved along the first direction X1, the first movable member 67 may be smoothly moved.

A plurality of hemming rollers 21, 22, and 23 may be mounted on the first movable member 67 to be rotatable, and a first block 91 that supports the first hemming roller 21 such that the first hemming roller 21 may be rotated, a second block 92 that supports the second hemming roller 22 such that the second hemming roller 22 may be rotated, and a third block 93 that supports the third hemming roller 23 such that the third hemming roller 23 may be rotated may be mounted on one end of the first movable member 67. Because the second block 92 and the third block 93 are disposed on opposite sides of the first block 91, the plurality of hemming rollers 21, 22, and 23 may be spaced apart from each other at a specific angle along a rotational direction of the carrier 25.

The plurality of hemming rollers 21, 22, and 23 may include a first hemming roller 21, a second hemming roller 22, and a third hemming roller 23.

According to an example, the first hemming roller 21 and the second hemming roller 22 may be preliminary hemming rollers that preliminarily hem the edge of the workpiece W, and the third hemming roller 23 may be a main roller that mainly hems the edge of the workpiece W.

The first hemming roller 21 may be mounted on the first block 91 to be rotated around the first rotational axis R1. The second hemming roller 22 may be mounted on the second block 92 to be rotated around the second rotational axis R2. The third hemming roller 23 may be mounted on the third block 93 to be rotated around the third rotational axis R3.

The first rotational axis R1 of the first hemming roller 21, the second rotational axis R2 of the second hemming roller 22, and the third rotational axis R3 of the third hemming roller 23 may be inclined at a specific angle with respect to the vertical line. The first rotational axis R1, the second rotational axis R2, and the third rotational axis R3 may be inclined at different angles.

As the wrist assembly 51 of the robot aim 50 is rotated, the carrier 25 may be rotated around the rotational axis Z of the wrist assembly 51, and the first hemming roller 21, the second hemming roller 22, and the third hemming roller 23 may sequentially contact the edge of the workpiece W as the carrier 25 is rotated as illustrated in FIGS. 9 to 11.

Because the hemming rollers 21, 22, and 23 are guided through an operation of the robot arm 50 in a state in which the hemming rollers 21, 22, and 23 contact the edge of the workpiece W, the edge of the workpiece W may be hemmed.

In some forms of the present disclosure, as illustrated in FIGS. 9 and 10, the inclination angle a1 of the first rotational axis R1 may be larger than the inclination angle a2 of the second rotational axis R2, and the third rotational axis R3 may be located on the vertical line. For example, the inclination angle a1 of the first rotational axis R1 may be 70° and the inclination angle a2 of the second rotational axis R2 may be 15°.

In this way, as the inclination angle a1 of the first rotational axis R1 and the inclination angle a2 of the second rotational axis r2 gradually decrease, the process of hemming the edge of the workpiece W may be effectively performed.

As the roller head 20 is guided by the robot arm 50, the first hemming roller 21, the second hemming roller 22, and the third hemming roller 23 may hem the edge of the workpiece W by stages.

As illustrated in FIGS. 9 to 11, the workpiece W may have an inner panel W1 and an outer panel W2, and the edge of the workpiece W may be hemmed by bending a flange F of the outer panel W2 with respect to the edge of the inner panel W1 by stages.

As illustrated in FIG. 9, as the first roller head 21 is guided along the die 12 of the hemming bed 10 by the robot aim 50 in a state in which the first hemming roller 21 is attached to the flange F of the outer panel W2 of the workpiece W, the flange F of the outer panel W2 may be bent at an angle corresponding to the inclination angle a1 of the first rotational axis R1 by a forming surface of the first hemming roller 21.

Next, as illustrated in FIG. 10, as the roller head 20 is guided along the die 12 of the hemming bed 10 by the robot aim 50 in a state in which the second hemming roller 22 is attached to the flange F of the outer panel W2 of the workpiece W, the flange F of the outer panel W2 may be bent at an angle corresponding to the inclination angle a2 of the second rotational axis R2 by a foaming surface of the second hemming roller 22.

Finally, as illustrated in FIG. 11, as the roller head 20 is guided along the die 12 of the hemming bed 10 by the robot aim 50 in a state in which the third hemming roller 23 is attached to the flange F of the outer panel W2 of the workpiece W, the flange F of the outer panel W2 may be completely bent vertically by a foaming surface of the third hemming roller 23, and accordingly, the flange F of the outer panel W2 may overlap the inner panel W1.

In some forms of the present disclosure, the roller head 20 may further include one or more guide rollers 24 connected to the carrier 25. The guide roller 24 may be disposed on a side that faces at least one of the hemming rollers 21, 22, and 23 to improve the hemming quality of the workpiece W by applying an opposing force that is applied against the press force on a side that is opposite to the hemming rollers 21, 22, and 23 when the hemming rollers 21, 22, and 23 press the edge of the workpiece W with a specific press force.

In some forms of the present disclosure, a single guide roller 24 may be disposed on a side that faces the third hemming roller 23, which is a main hemming roller.

As the guide roller 24 is moved along the first direction X1 by the second cylinder 62, an opposing force applied to the rear surface of the workpiece W may be adjusted. When the edge of the workpiece W is hemmed by the third hemming roller 23, the guide roller 24 may be moved along the first direction X1 on a side that faces the third hemming roller 23, and in particular, as the guide roller 24 is moved in a direction that is opposite to the movement direction of the third hemming roller 23, the guide roller 24 may apply an opposing force that is applied against the press force of the third hemming roller 23.

As illustrated in FIG. 12, the second cylinder 62 may be a pneumatic or hydraulic cylinder that is operated as a fluid, such as air or oil, is supplied. A second adjusting valve 27 may be connected to the second cylinder 62, and the second adjusting valve 27 may be configured to adjust the flow rate of the fluid supplied to the second cylinder 62. The second adjusting valve 27 may have a second solenoid 27*a* that adjusts a degree of valve opening. As the degree of valve opening of the second adjusting valve 27 is adjusted by the second solenoid 27*a*, the flow rate of the fluid supplied to the second cylinder 62 may be adjusted. For example, the second adjusting valve 27 may be an electro-pneumatic proportional valve.

A second controller 42 may be connected to the second solenoid 27*a* of the second adjusting valve 27, and the second controller 42 may have a pair of sensors 42*a* and 42*b* that detects a feedback signal FB, such as a voltage or a current of the second solenoid 27*a*. The second controller 42 may compare the feedback signal FB detected by the pair of sensors 42*a* and 42*b* with a second setting level to adjust a voltage or a current supplied to the second solenoid 27*a* and the flow rate of the fluid supplied to the second cylinder 62 may be adjusted by adjusting the degree of valve opening of the second adjusting valve 27 with the second solenoid 27*a*, and accordingly, an opposing force of the guide roller 24 may be adjusted. Here, the second setting level may be set to the voltage or current supplied to the second solenoid 27*a* when the edge of the work piece W is smoothly bent.

In this way, because the opposing force of the guide roller 24 may be adjusted by the second cylinder 62, the second adjusting valve 27, the second controller 42, and the like according to the type and the structure of the workpiece W and sections of the edge, the hemming quality of the workpiece W may be remarkably improved. For example, when the workpiece W is a wheel arch of the vehicle, the opposing force of the guide roller 24 may decrease to a minimum valve because the degree of bending of the shortest part of the flange F needs to be minimized, and the opposing force of the guide roller 24 may increase to a maximum value because the degree of bending at the longest part of the flange F needs to be maximized.

The second cylinder 62 may have a second cylinder housing 64 and a second cylinder rod 66. The second cylinder rod 66 may be mounted on the second cylinder housing 64 to be movable along a first direction X1. A second movable member 68 is fixed to an end of the second cylinder rod 66, and accordingly, the second movable member 68 may be moved along the first direction X1 as the second cylinder rod 66 moves.

The second cylinder housing 64 of the second cylinder 62 may be fixedly connected to a second plate 72 by a second bracket 74, and the second plate 72 may extend along the first direction X1.

A second guide rail 76 may be mounted on the second plate 72, and the second guide rail 76 may extend along the first direction X1. A second slider 78 may be installed in the second guide rail 76 to be slid, and the second movable member 68 may be fixed to the second slider 78.

A connection piece 70 protrudes from one side of the second movable member 68. The second cylinder rod 66 of the second cylinder 62 may be fixed to the connection piece 70 of the second movable member 68. Accordingly, as the second cylinder rod 6 is moved forwards or rearwards, the second movable member 68 may be moved along the first direction X1. The movement of the second movable member 68 may be precisely guided by the second slider 78 and the second guide rail 76.

The guide roller 24 may be mounted on one end of the second movable member 68 to be rotatable.

The first plate 71 and the second plate 72 may be fixed to the mounting plate 79, and the mounting plate 79 may be connected to the carrier 25 via a floating unit 80.

The floating unit 80 may be configured to move the first and second plates 71 and 72 of the roller head 20 in three axis directions, and accordingly, may move the hemming rollers 21, 22, and 23 and the guide roller 24 of the roller head 20 in three axis directions that are perpendicular to each other.

In some forms of the present disclosure, the floating unit 80 may include a base member 84, a first floating member 81 connected to the base member 84 to be movable along the first direction X1, a second floating member 82 connected to the first floating member 81 to be movable along the second direction X2, and a third floating member 83 connected to the second floating member 82 to be movable along the third direction X3. For example, the floating unit 80 may include a compensation unit, such as AGE-S-XYZ (product name) of SCHUNK GmbH & Co KG (manufacturer).

The floating member 81 may be connected to the base member 84 to be movable along the first direction X1. A plurality of springs 85 may be disposed between the first floating member 81 and the base member 84, and the springs 85 may be disposed along the first direction X1. Accordingly, the first floating member 81 may be movable along the first direction X1 because the first floating member 81 is elastically supported by the plurality of springs 85 along the first direction X1.

The second floating member 82 may be connected to the first floating member 81 to be movable along the second direction X2. A plurality of first guide rails 86 may be disposed between the first floating member 81 and the second floating member 82, and the first guide rails 86 may extend along the second direction X2. Accordingly, the second floating member 82 may be moved along the plurality of first guide rails 86.

The third floating member 83 may be connected to the second floating member 82 to be movable along the third direction X3. A plurality of second guide rails 87 may be disposed between the third floating member 83 and the second floating member 83, and the second guide rails 87 may extend along the third direction X3. Accordingly, the third floating member 83 may be moved along the plurality of second guide rails 87.

The third floating member 83 may have a coupling part 89, to which the mounting plate 79 of the roller head 20 is coupled to be separable.

The second direction X2 and the third direction X3 may be perpendicular to each other, and the first direction X1 may be perpendicular to the second direction X2 and the third direction X3.

The floating unit 80 may further include a locking device (not illustrated) that locks or unlocks the first floating member 81, the second floating member 82, and the third floating member 83, and the locking device (not illustrated) may be a hydraulic locking device that is operated pneumatically or hydraulically.

If the first floating member 81, the second floating member 82, and the third floating member 83 are locked by the locking device (not illustrated), the first floating member 81, the second floating member 82, and the third floating member 83 are prevented from being moved.

If the first floating member 81, the second floating member 82, and the third floating member 83 are unlocked by the locking device (not illustrated), the first floating member 81 may be moved along the first direction X1, the second floating member 82 may be moved along the second direction X2, and the third floating member 83 may be moved along the third direction X3.

As described above, during the unlocking operation of the locking device (not illustrated), the mounting plate 79 and the first and second plates 71 and 72 may be moved in three directions X1, X2, and X3 as the first floating member 81, the second floating member 82, and the third floating member 83 of the floating unit 80 are individually moved along the three axis directions X1, X2, and X3, and accordingly, the plurality of hemming rollers 21, 22, and 23 and the guide roller 24 may be moved along the three directions X1, X2, and X3.

When the workpiece W is preliminarily hemmed by the first and second hemming rollers 21 and 22, which are preliminary hemming rollers, the movement loci of the hemming rollers 21, 22, and 23 and the guide roller 24 may be adjusted by moving the first floating member 81, the second floating member 82, and the third floating member 83 in the directions X2, X3, and X1, and the movement loci of the hemming rollers 21, 22, and 23 and the guide roller 24 may be mechanically corrected by adjusting the vertical location and/or the horizontal location of the guide member 13 in a state in which the locking device (not illustrated) of the floating unit 80 is unlocked.

As described above, because the first floating member 81, the second floating member 82, and the third floating member 83 are prevented from being moved through the locking operation of the locking device (not illustrated) of the floating unit 80 in a state in which the movement locus of the roller head 20 is mechanically adjusted by the floating unit 80 and the guide member 13 in the preliminary hemming process, the adjusted movement loci of the hemming rollers 21, 22, and 23 and the guide roller 24 may be maintained. In this state, the hemming quality may be remarkably improved because the third hemming roller 23, which is a main hemming roller, mainly hems the flange F of the workpiece W.

In this way, correction of robot teaching may be minimized by mechanically correcting the movement loci of the hemming rollers 21, 22, and 23 and the guide roller 24 through the adjustment of the locations of the floating unit 80 and the guide member 13, and accordingly, the hemming quality may be effectively improved.

The hemming bed 10 may be held on a holder, and the hemming bed 10 held on the holder may be fed to the workpiece W by the robot arm 50 and the carrier 25. The hemming bed 10 may be fed to a location that is adjacent to the workpiece W as the robot arm 50 is operated in a state in which the carrier 25 is temporarily coupled to the hemming bed 10, and thereafter, the frame 11 and the die 12 of the hemming bed 10 may be coupled to the workpiece W by the clamps 15, 16, and 17.

The carrier 25 may have one or more clamps 45, and the clamp 45 may be disposed at an upper end of the carrier 25. Because the carrier 25 and the frame 11 are clamped by the clamp 45 in a state in which the carrier 25 and the frame 11 is temporarily coupled to each other, the hemming bed 10 may be prevented from being separated from the carrier 25 during the feeding of the hemming bed 10.

The frame 11 may have a plurality of insertion holes 35, and the carrier 25 may have a plurality of insertion bosses 33. As the insertion bosses 33 of the carrier 25 are individually inserted into the insertion holes 35 of the frame 11, the carrier 25 may be temporarily coupled to the frame 11 of the hemming head 10. As the robot aim 50 is operated in a state in which the carrier 25 is temporarily coupled to the frame 11 of the hemming bed 10, the hemming bed 10 may approach the workpiece W.

The frame 11 may be provided with a first power supply 36, and the carrier 25 may be provided with a second power supply 37. The first power supply 36 and the second power supply 37 supply electric power to various actuators and electric parts.

In some forms of the present disclosure, the hemming quality of the workpiece may be remarkably improved by adjusting the press forces of the hemming rollers and/or the opposing force of the guide roller through feedback control according to the type and the structure of the workpiece and sections of the edge.

Also, in some forms of the present disclosure, because the movement loci of the hemming rollers and the guide roller may be mechanically corrected by adjusting the locations of the floating unit and the guide member, the correction of robot teaching may be reduced, and accordingly, the hemming quality may be effectively improved.

The disclosed forms of the present disclosure do not limit the technical spirit of the present disclosure but are illustrative, and the scope of the technical spirit of the present disclosure is not limited by the forms of the present disclosure. The scope of the present disclosure should be construed by the claims, and it will be understood that all the technical spirits within the equivalent range fall within the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A roller hemming apparatus comprising:

a hemming bed comprising a frame and a die, wherein the hemming bed is detachably coupled to a workpiece; and a roller head comprising hemming rollers that are configured to hem an edge of the workpiece by stages and a guide roller, wherein a press force that presses the edge of the workpiece is adjusted by moving a plurality of hemming rollers along a first direction with a first cylinder when each hemming roller of the plurality of hemming rollers hems the edge of the workpiece, and wherein the hemming bed comprises:

the frame;

the die connected to the frame, wherein the die is configured to contact the workpiece; and a guide member detachably coupled to the die, wherein the guide member comprises a guide groove that is configured to guide the guide roller.

2. The roller hemming apparatus of claim 1, wherein the apparatus comprises:

a first adjusting valve configured to adjust a flow rate of fluid that is supplied to the first cylinder, wherein the first adjusting valve is connected to the first cylinder and the first adjusting valve has a first solenoid that is configured to adjust a degree of valve opening.

3. The roller hemming apparatus of claim 2, wherein the apparatus comprises:

a first controller having a pair of sensors that are configured to detect a feedback signal of the first solenoid, wherein the first controller is configured to:

connect to the first solenoid;

compare the feedback signal of the first solenoid with a first setting level; and adjust a voltage or a current supplied to the first solenoid.

4. The roller hemming apparatus of claim 3, wherein:

the first setting level is set to the voltage or the current that is supplied to the first solenoid such that the edge of the workpiece is smoothly bent.

5. The roller hemming apparatus of claim 2, wherein:

the first adjusting valve is an electro-pneumatic proportional valve.

6. The roller hemming apparatus of claim 3, wherein the guide roller is disposed on a side that faces at least one hemming roller of the plurality of hemming rollers and the guide roller is configured to apply an opposing force that applies against the press force on an opposite side of the at least one hemming roller of the plurality of hemming rollers when the at least one hemming roller of the plurality of hemming rollers presses the edge of the workpiece with the press force.

7. The roller hemming apparatus of claim 6, wherein:

the guide roller is configured to move along the first direction by a second cylinder such that the opposing force is adjusted.

8. The roller hemming apparatus of claim 7, wherein the apparatus comprises:

a second adjusting valve having a second solenoid that is configured to adjust a degree of valve opening, wherein the second adjusting valve is configured to:

adjust a flow rate of fluid supplied to the second cylinder; and connect to the second cylinder.

9. The roller hemming apparatus of claim 8, wherein a second controller having a pair of sensors is configured to:

connect to the second solenoid;

compare a feedback signal of the second solenoid with a second setting level, wherein the pair of sensors are configured to detect the feedback signal of the second solenoid; and adjust a voltage or a current supplied to the second solenoid.

10. The roller hemming apparatus of claim 9, wherein the second setting level is set to the voltage or the current that is supplied to the second solenoid such that the edge of the workpiece is smoothly bent.

11. The roller hemming apparatus of claim 8, wherein the second adjusting valve is an electro-pneumatic proportional valve.

12. The roller hemming apparatus of claim 1, wherein the roller head further comprises:

a carrier to which a wrist assembly of a robot arm is detachably coupled, wherein the plurality of hemming rollers connect to the carrier through the first cylinder.

13. The roller hemming apparatus of claim 1, wherein the apparatus further comprises:

a floating unit configured to:

connect to the carrier; and move the plurality of hemming rollers along three axes, wherein each axis of the three axes is perpendicular to one another.

14. The roller hemming apparatus of claim 1, wherein the die comprises:

a first surface contacting an outer surface of the workpiece; and a second surface formed on an opposite side of the first surface, and wherein the guide member is detachably mounted on the second surface through a coupling device.

15. The roller hemming apparatus of claim 14, wherein:

the second surface is configured to adjust a location of the guide member.

16. The roller hemming apparatus of claim 15, wherein the die comprises a pair of adjusting ribs that are formed on both ends of the die, wherein the guide member comprises a pair of supporting members corresponding to the pair of adjusting ribs, and wherein adjusting members are interposed between the support members and the adjusting ribs.

* * * * *